US011279007B1

(12) United States Patent
Stoll

(10) Patent No.: US 11,279,007 B1
(45) Date of Patent: Mar. 22, 2022

(54) TELESCOPIC CRANK HANDLE DRILL BIT ATTACHMENT

(71) Applicant: William Stoll, Glen Rock, PA (US)

(72) Inventor: William Stoll, Glen Rock, PA (US)

( * ) Notice: Subject to any disclaimer, the term of this patent is extended or adjusted under 35 U.S.C. 154(b) by 359 days.

(21) Appl. No.: 16/680,573

(22) Filed: Nov. 12, 2019

(51) Int. Cl.
*B25B 23/00* (2006.01)
*B25B 23/16* (2006.01)
*B25B 13/50* (2006.01)

(52) U.S. Cl.
CPC ..... *B25B 23/0064* (2013.01); *B25B 13/5091* (2013.01); *B25B 23/0035* (2013.01); *B25B 23/16* (2013.01)

(58) Field of Classification Search
CPC ..... B25B 13/48; B25B 13/481; B25B 13/50; B25B 13/5091; B25B 23/0064; B25B 23/0035; B25B 23/16; B25B 9/00; B25G 1/043; H01K 3/32
See application file for complete search history.

(56) References Cited

U.S. PATENT DOCUMENTS 6,095,016 A * 8/2000 Lam ..... B25B 13/5091 81/121.1
6,171,033 B1 * 1/2001 Wrobel ..... B23B 51/126 279/145
6,499,778 B2 * 12/2002 Boulay ..... B25B 9/00 254/134.3 R
6,526,850 B1 3/2003 Miller
6,901,825 B1 6/2005 Lebron
6,962,173 B1 11/2005 Fishgrab
7,357,612 B1 4/2008 Paul
D576,007 S 9/2008 Murdock
9,178,341 B2 11/2015 Maltby
9,321,158 B2 * 4/2016 Calvert ..... B25B 9/00
D776,507 S 1/2017 Faverio
10,323,456 B2 * 6/2019 Lin ..... E06B 9/76
10,773,376 B2 * 9/2020 Calvert ..... B25B 23/0021
2002/0088313 A1 * 7/2002 Dockery ..... B25B 23/0035 81/121.1
2012/0255400 A1 * 10/2012 Flud ..... B25B 13/5091 81/176.1
2013/0098212 A1 * 4/2013 Ingersoll ..... B25G 1/043 81/177.2

* cited by examiner

*Primary Examiner* — David B. Thomas
(74) *Attorney, Agent, or Firm* — Kyle A. Fletcher, Esq.

(57) ABSTRACT

The telescopic crank handle drill bit attachment comprises a hook, an extendable rod, and a drill attachment. The telescopic crank handle drill bit attachment may couple to a crank coupler of an overhead retractable device. The telescopic crank handle drill bit attachment may rotate the crank coupler when the telescopic crank handle drill bit attachment is turned using a rotary tool. As non-limiting examples, the overhead retractable device may be an awning, a window blind, or a skylight. The telescopic crank handle drill bit attachment may rotate the crank coupler in a first rotational direction to move the overhead retractable device in a first operational direction. The telescopic crank handle drill bit attachment may rotate the crank coupler in a second rotational direction to move the overhead retractable device in a second operational direction.

19 Claims, 5 Drawing Sheets

TELESCOPIC CRANK HANDLE DRILL BIT ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of extension handles, more specifically, a telescopic crank handle drill bit attachment.

SUMMARY OF INVENTION

The telescopic crank handle drill bit attachment comprises a hook, an extendable rod, and a drill attachment. The telescopic crank handle drill bit attachment may couple to a crank coupler of an overhead retractable device. The telescopic crank handle drill bit attachment may rotate the crank coupler when the telescopic crank handle drill bit attachment is turned using a rotary tool. As non-limiting examples, the overhead retractable device may be an awning, a window blind, or a skylight. The telescopic crank handle drill bit attachment may rotate the crank coupler in a first rotational direction to move the overhead retractable device in a first operational direction. The telescopic crank handle drill bit attachment may rotate the crank coupler in a second rotational direction to move the overhead retractable device in a second operational direction.

An object of the invention is to provide an extension handle for turning a crank coupler on an overhead retractable device.

Another object of the invention is to provide a drill attachment to allow a rotary tool to turn the crank coupler.

A further object of the invention is to provide an extendable rod between a hook and a drill attachment for adjusting the height of the invention.

Yet another object of the invention is to provide an extendable rod comprised of a plurality of rod sections that may telescope or may be individually added and removed.

These together with additional objects, features and advantages of the telescopic crank handle drill bit attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the telescopic crank handle drill bit attachment in detail, it is to be understood that the telescopic crank handle drill bit attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the telescopic crank handle drill bit attachment.

It is therefore important that the claims be regarded as including such equivalent construction insofar as they do not depart from the spirit and scope of the telescopic crank handle drill bit attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
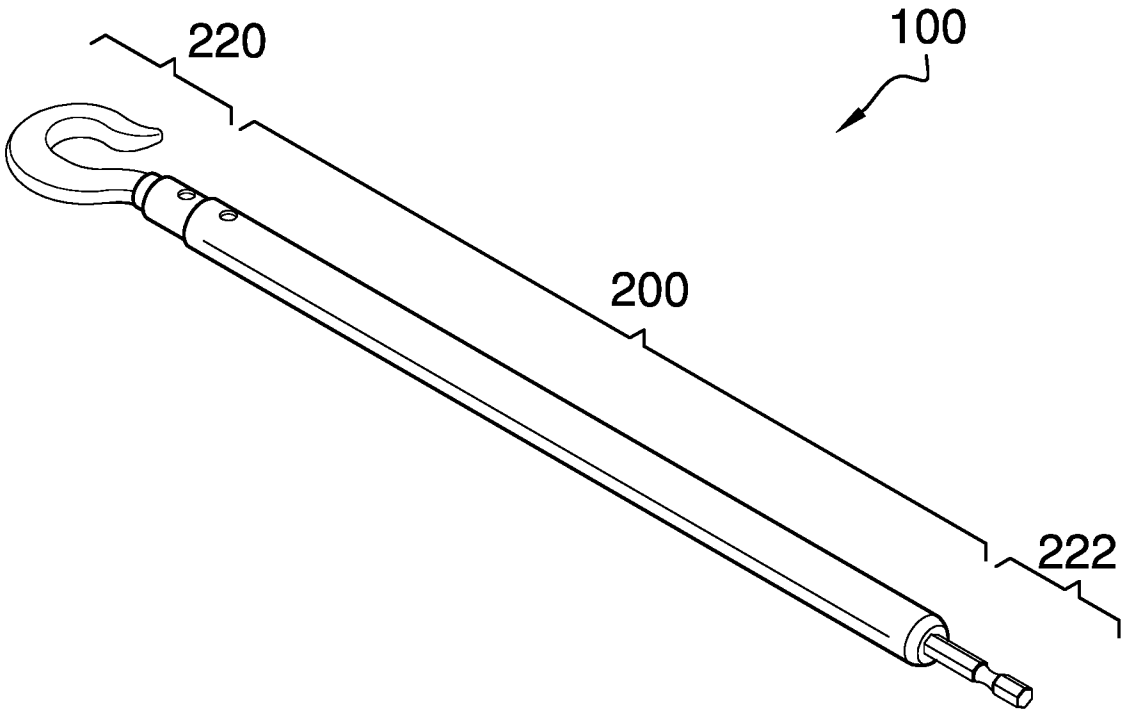
FIG. 1 is an isometric view of an embodiment of the disclosure illustrating the invention in a collapsed state.
Figure 2:
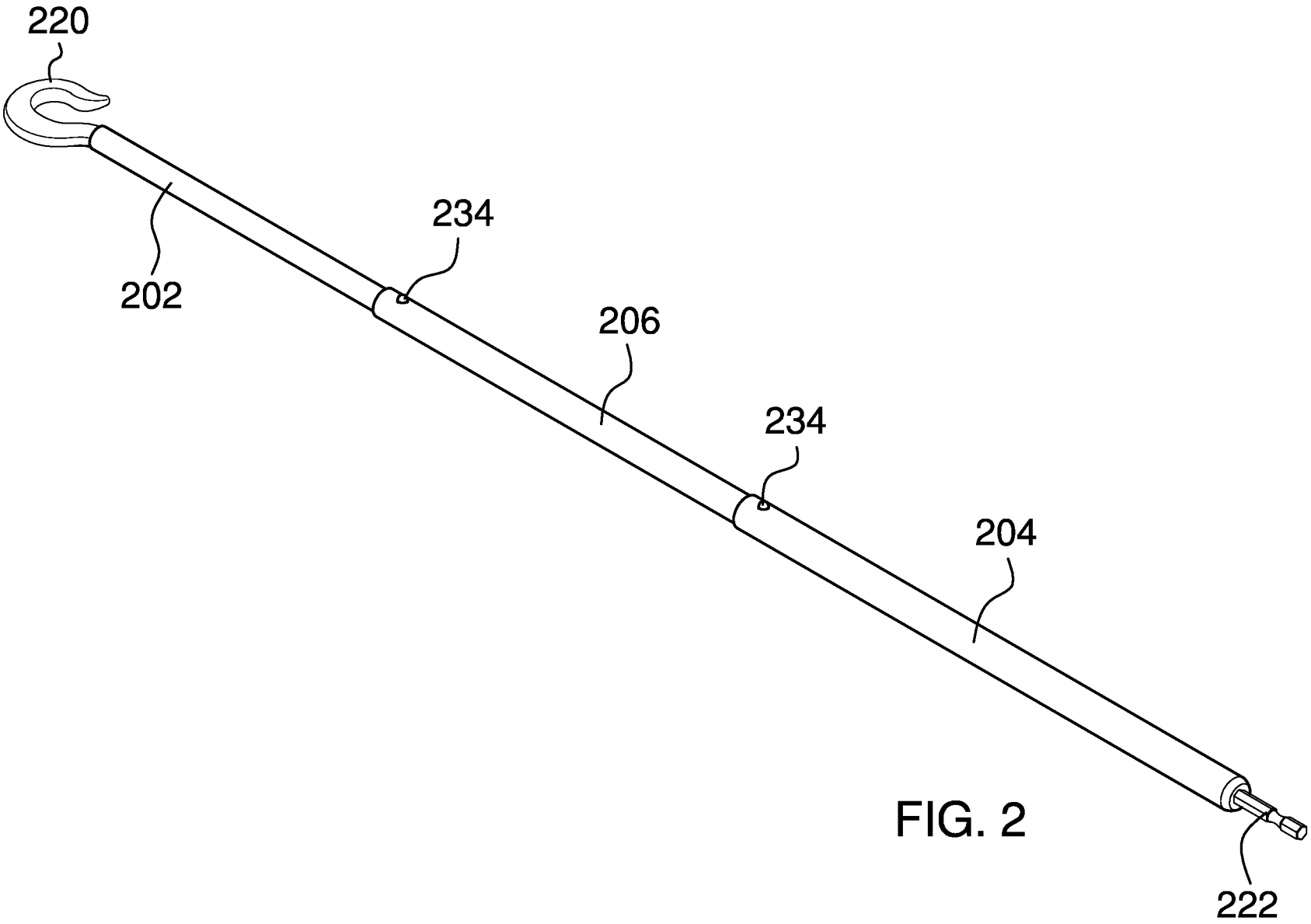
FIG. 2 is an isometric view of an embodiment of the disclosure illustrating the invention in an extended state.
Figure 3:
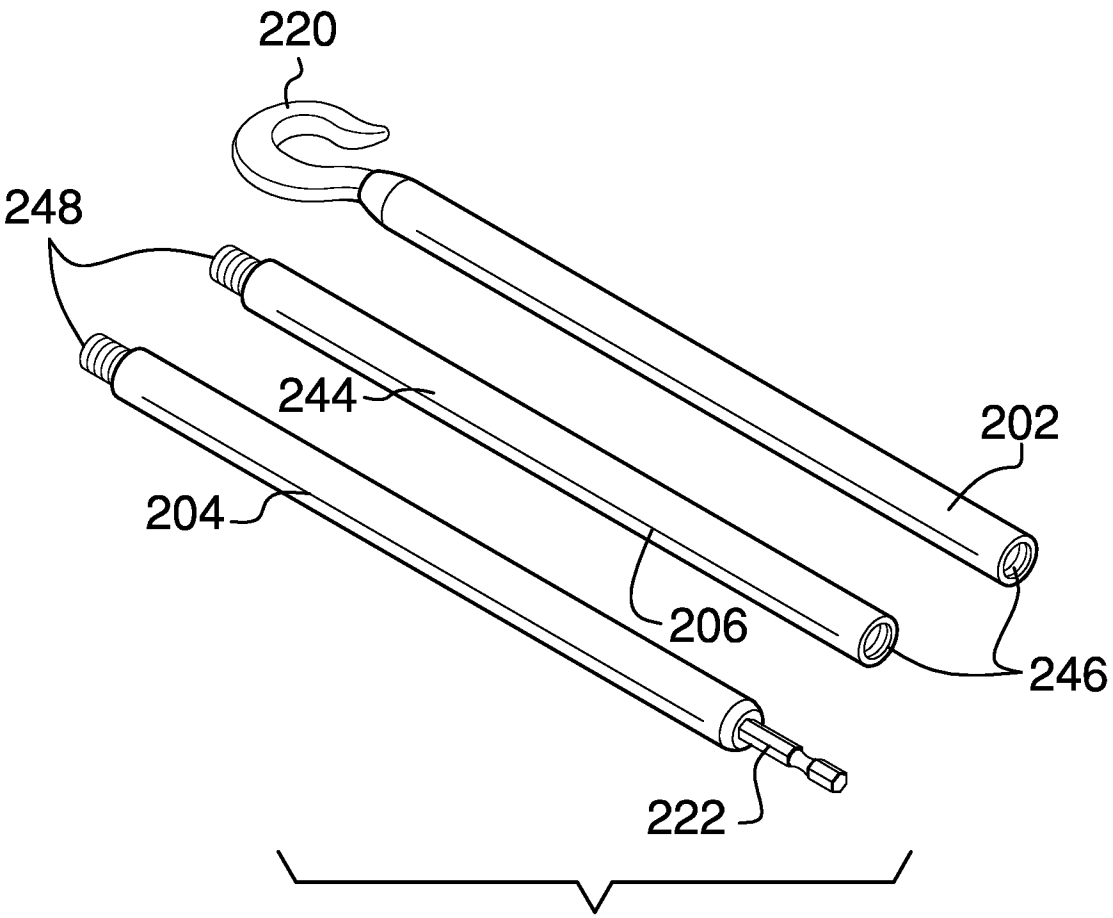
FIG. 3 is an exploded view of an alternative embodiment of the disclosure illustrating individually removable rod sections.
Figure 4:
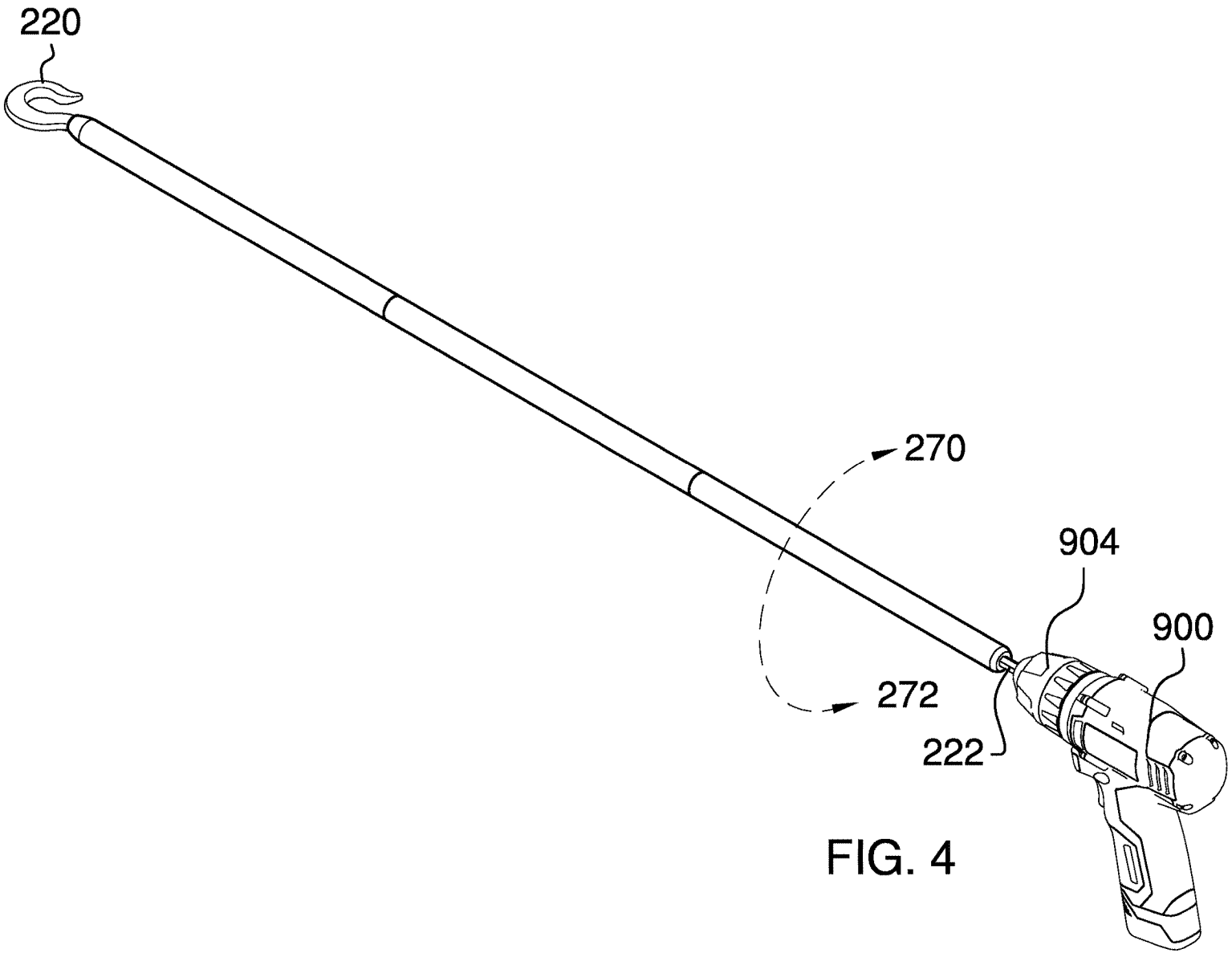
FIG. 4 is an isometric view of an alternative embodiment of the disclosure illustrating the invention in an extended state and with a rotary tool coupled to the drill attachment.
Figure 5:
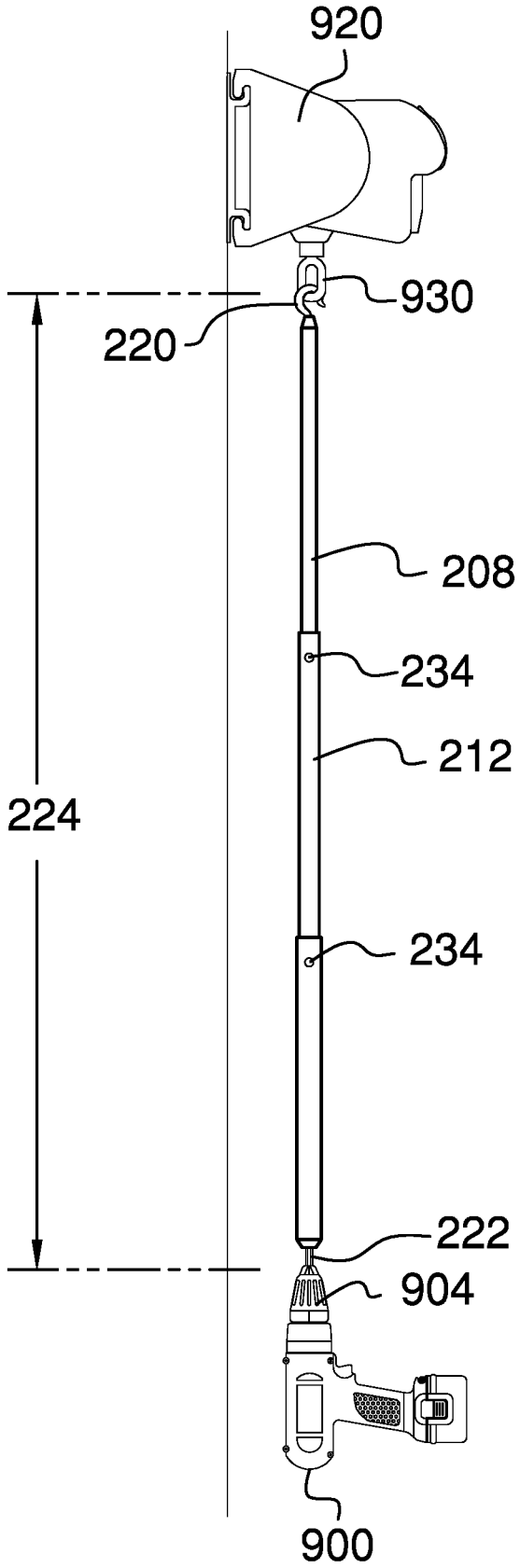
FIG. 5 is an in-use view of an embodiment of the disclosure illustrating an overhead retractable device and the rotary tool coupled to the invention.

Detailed reference will now be made to a first potential embodiment of the disclosure, which is illustrated in FIGS. 1 through 5.

The telescopic crank handle drill bit attachment 100 (hereinafter invention) comprises a hook 220, an extendable rod 200, and a drill attachment 222. The invention 100 may couple to a crank coupler 930 of an overhead retractable device 920. The invention 100 may rotate the crank coupler 930 when the invention 100 is turned using a rotary tool 900. As non-limiting examples, the overhead retractable device 920 may be an awning, a window blind, or a skylight. The invention 100 may rotate the crank coupler 930 in a first rotational direction 270 to move the overhead retractable device 920 in a first operational direction. The invention 100 may rotate the crank coupler 930 in a second rotational direction 272 to move the overhead retractable device 920 in a second operational direction. As non-limiting examples, rotating the crank coupler 930 in the first rotational direction 270 may cause the awning to extend, the window blind to open, or the skylight to lift up. Rotating the crank coupler 930 in the second rotational direction 272 may cause the awning to retract, the window blind to close, or the skylight to drop down.

The hook 220 may be a bent armature that is oriented with the point down. (For clarification of directional terms such as up and down, refer to FIG. 5.) The top of the hook 220 may removably couple with the crank coupler 930 on the overhead retractable device 920 such that rotation of the hook 220 in either rotational direction may cause the crank coupler 930 to rotate in that same rotational direction. The bottom of the hook 220 may couple to a top rod section 202 of the extendable rod 200.

The extendable rod 200 may couple the hook 220 to the drill attachment 222 via a plurality of rod sections. The extendable rod 200 may be variable length. The extendable rod 200 may be adapted to adjust for a difference in height 224 between the rotary tool 900 held by a user and the crank coupler 930 on the overhead retractable device 920.

The extendable rod 200 may comprise the top rod section 202, a bottom rod section 204, and one or more intermediate rod sections 206. The top rod section 202 may be coupled to the hook 220, the bottom rod section 204 may be coupled to the drill attachment 222, and the one or more intermediate rod sections 206 may couple the top rod section 202 to the bottom rod section 204.

In some embodiments, the top rod section 202, the bottom rod section 204, the one or more intermediate rod sections 206, or combinations thereof may be dissimilar lengths.

The drill attachment 222 may be a shaft coupled to the bottom of the bottom rod section 204 of the extendable rod 200. The drill attachment 222 may be inserted into a drill chuck 904 of the rotary tool 900 and the drill chuck 904 may be closed to grasp the drill attachment 222 such that the rotary tool 900 may turn the invention 100. In some embodiments, the drill attachment 222 may have a lateral cross-section that is hexagonal such that a plurality of jaws of the drill chuck 904 may press against planar surfaces.

In some embodiments, the plurality of rod sections may be telescopically nested to slide within each other in order to vary the length of the extendable rod 200. As a non-limiting example, the outside diameter of an individual rod section 208 selected from the plurality of rod sections may be smaller than the inside diameter of an adjacent rod section 212 that is immediately below the individual rod section 208. A height adjustment lock 234 may lock the individual rod section 208 to the adjacent rod section 212 to retain the extendable rod 200 at a fixed length. In some embodiments, the height adjustment lock 234 may be a single end button clip. As non-limiting examples, the height adjustment lock 234 may also be a double end button clip, twist locks, or quick release flip locks.

In some embodiments, the plurality of rod sections may be independent and separate from each other. The plurality of rod sections may be individually added to or removed from the extendable rod 200 in order to vary the length of the extendable rod 200. As a non-limiting example, an individual extension 244 selected from the plurality of rod sections may comprise a female threaded end 246 and a male threaded end 248. The female threaded end 246 on the individual rod section 208 may couple to the male threaded end 248 on the adjacent rod section 212. The bottom of the top rod section 202 may terminate with the female threaded end 246 and the top of the bottom rod section 204 may terminate with the male threaded end 248 such that the top rod section 202 and the bottom rod section 204 may couple to the one or more intermediate rod sections 206.

Those skilled in the art will recognize that throughout this description the positions of the female threaded ends 246 and the positions of the male threaded ends 248 may be reversed without departing from the scope and spirit of the invention. As a non-limiting example, the male threaded end 248 on the individual rod section 208 may couple to the female threaded end 246 on the adjacent rod section 212, the bottom of the top rod section 202 may terminate with the male threaded end 248, and the top of the bottom rod section 204 may terminate with the female threaded end 246.

In use, the drill attachment 222 is coupled to the rotary tool 900. As a non-limiting example, the drill attachment 222 may be placed into the drill chuck 904 of a cordless drill and the drill chuck 904 may be tightened. The length of the extendable rod 200 may be varied until the hook 220 is inserted into the crank coupler 930 of the overhead retractable device 920. The rotary tool 900 may be set to turn in the first rotational direction 270 or the second rotational direction 272 depending upon the action to be taken. As a non-limiting example, turning the crank coupler 930 in the first rotational direction 270 may cause the awning to extend. The hook 220 may be removed from the crank coupler 930 when the overhead retractable device 920 is in a desired state.

In some embodiments, varying the length of the extendable rod 200 may involve sliding the individual rod sections 208 in and out of the adjacent rod sections 212 and locking the plurality of rod sections together using the height adjustment locks 234. In some embodiments, varying the length of the extendable rod 200 may involve adding or removing the individual rod sections 208. The individual rod sections 208 may be added by coupling the female threaded end 246 on the individual rod sections 208 to the male threaded end 248 on the adjacent rod sections 212. The individual rod sections 208 may be removed by decoupling the female threaded end 246 on the individual rod sections 208 from the male threaded end 248 on the adjacent rod sections 212.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "button clip" refers to a type of fastener frequently used to lock the length of telescoping tubes. The button clip may be a V-shaped metal spring comprising a button where the button is coupled to an end of the spring and points away from the center of the spring. The spring may be placed inside of a first tube and moved to a position where the button protrudes through a first aperture in the side of the first tube. A second tube of larger diameter may slide over the first tube until the button aligns with a second aperture located on the side of the second tube at which point the spring may force the button into the second aperture, locking the first and second tubes together. The tubes may be unlocked and allowed to slide by pressing the button in to disengage the second aperture. The second tube may comprise a plurality of apertures that are linearly aligned such that the overall length of tubes may be change by moving the button to a different aperture on the second tube. A button clip comprising only one button may be referred to as a single end button clip. A double end button clip may comprise two buttons that are located on opposite sides of the spring. The double end button clip may operate using two apertures on opposite sides of the first tube and one or more sets of apertures on opposite sides of the second tube.

As used herein, the words "couple", "couples", "coupled" or "coupling", refer to connecting, either directly or indirectly, and does not necessarily imply a mechanical connection.

As used herein, "lateral cross-section" refers to a cross-section that is perpendicular to the longitudinal axis.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "inside diameter" or "inner diameter" refers to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, the term "intermediate" refers to a location that lies between a first object and a second object As used in this disclosure, the word "lateral" refers to the sides of an object or movement towards a side. Lateral directions are generally perpendicular to longitudinal directions. "Laterally" refers to movement in a lateral direction.

As used herein, "outside diameter" or "outer diameter" refers to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, the term "shaft" is used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used herein, "spring loaded" refers to an item that contains a compressed or stretched spring that presses one part against another part.

As used in this disclosure, "telescopic", "telescoping", and "telescopically" refer to an object made of sections that fit or slide into each other such that the object can be made longer or shorter by adjusting the relative positions of the sections.

As used in this disclosure, a "tool" is a device, an apparatus, or an instrument that is used to carry out an activity, operation, or procedure.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A telescopic crank handle drill bit attachment comprising:

a hook, an extendable rod, and a drill attachment;

wherein the telescopic crank handle drill bit attachment couples to a crank coupler of an overhead retractable device;

wherein the telescopic crank handle drill bit attachment rotates the crank coupler when the telescopic crank handle drill bit attachment is turned using a rotary tool;

wherein the telescopic crank handle drill bit attachment rotates the crank coupler in a first rotational direction to move the overhead retractable device in a first operational direction;

wherein the telescopic crank handle drill bit attachment rotates the crank coupler in a second rotational direction to move the overhead retractable device in a second operational direction.

2. The telescopic crank handle drill bit attachment according to claim 1 wherein the hook is a bent armature that is oriented with the point down.

3. The telescopic crank handle drill bit attachment according to claim 2 wherein the top of the hook removably couples with the crank coupler on the overhead retractable device such that rotation of the hook in either rotational direction causes the crank coupler to rotate in that same rotational direction.

4. The telescopic crank handle drill bit attachment according to claim 3 wherein the bottom of the hook couples to a top rod section of the extendable rod.

5. The telescopic crank handle drill bit attachment according to claim 4 wherein the extendable rod couples the hook to the drill attachment via a plurality of rod sections.

6. The telescopic crank handle drill bit attachment according to claim 5 wherein the extendable rod is variable length.

7. The telescopic crank handle drill bit attachment according to claim 6 wherein the extendable rod is adapted to adjust for a difference in height between the rotary tool held by a user and the crank coupler on the overhead retractable device.

8. The telescopic crank handle drill bit attachment according to claim 7 wherein the extendable rod comprises the top rod section, a bottom rod section, and one or more intermediate rod sections;

wherein the top rod section is coupled to the hook, the bottom rod section is coupled to the drill attachment, and the one or more intermediate rod sections couple the top rod section to the bottom rod section.

9. The telescopic crank handle drill bit attachment according to claim 8 wherein the top rod section, the bottom rod section, the one or more intermediate rod sections, or combinations thereof are dissimilar lengths.

10. The telescopic crank handle drill bit attachment according to claim 9 wherein the drill attachment is a shaft coupled to the bottom of the bottom rod section of the extendable rod;

wherein the drill attachment is inserted into a drill chuck of the rotary tool and the drill chuck is closed to grasp the drill attachment such that the rotary tool turns the telescopic crank handle drill bit attachment.

11. The telescopic crank handle drill bit attachment according to claim 10 wherein the drill attachment has a lateral cross-section that is hexagonal such that a plurality of jaws of the drill chuck press against planar surfaces.

12. The telescopic crank handle drill bit attachment according to claim 10 wherein the plurality of rod sections are telescopically nested to slide within each other in order to vary the length of the extendable rod.

13. The telescopic crank handle drill bit attachment according to claim 12 wherein the outside diameter of an individual rod section selected from the plurality of rod sections is smaller than the inside diameter of an adjacent rod section that is immediately below the individual rod section.

14. The telescopic crank handle drill bit attachment according wherein a height adjustment lock locks the individual rod section to the adjacent rod section to retain the extendable rod at a fixed length.

15. The telescopic crank handle drill bit attachment according to claim 14 wherein the height adjustment lock is a single end button clip.

16. The telescopic crank handle drill bit attachment according to claim 10 wherein the plurality of rod sections are independent and separate from each other;

wherein the plurality of rod sections are individually added to or removed from the extendable rod in order to vary the length of the extendable rod.

17. The telescopic crank handle drill bit attachment according to claim 16 wherein an individual extension selected from the plurality of rod sections comprises a female threaded end and a male threaded end.

18. The telescopic crank handle drill bit attachment according to claim 17 wherein the female threaded end on the individual rod section couples to the male threaded end on the adjacent rod section.

19. The telescopic crank handle drill bit attachment according to claim 18 wherein the bottom of the top rod section terminates with the female threaded end and the top of the bottom rod section terminates with the male threaded end such that the top rod section and the bottom rod section couple to the one or more intermediate rod sections.

* * * * *